United States Patent [19]

Spekman, Jr.

[11] 4,235,051

[45] Nov. 25, 1980

[54] FINISHING COMPOUND FOR BARREL AND VIBRATORY SURFACE CONDITIONING OF FERROUS AND NON-FERROUS METALS

[75] Inventor: Paul Spekman, Jr., Bloomington, Minn.

[73] Assignee: Fremont Industries, Inc., Shakopee, Minn.

[21] Appl. No.: 50,672

[22] Filed: Jun. 21, 1979

[51] Int. Cl.[3] ..... B24B 1/00

[52] U.S. Cl. ..... 51/316

[58] Field of Search ..... 51/313, 316, 164.5, 51/7

[56] References Cited

U.S. PATENT DOCUMENTS

| | | | |
|---|---|---|---|
| 3,321,873 | 5/1967 | Leveskis | 51/316 |
| 3,979,858 | 9/1976 | Semones | 51/316 |

FOREIGN PATENT DOCUMENTS

| | | | |
|---|---|---|---|
| 931003 | 7/1963 | United Kingdom | 51/316 |

*Primary Examiner*—Harold D. Whitehead

*Attorney, Agent, or Firm*—Orrin M. Haugen; Thomas J. Nikolai

[57] ABSTRACT

A method and formulation for imparting a smooth finish to metallic components by subjecting the components to relative motion within a barrel or vibratory finishing machine, wherein the metallic components are immersed in a media which includes abrasive particles and an aqueous working solution of a metal finishing compound. The metal finishing compound includes a mixture of the tetrasodium salt of ethylenediaminetetraacetic acid, triethanolamine, the sodium salt of the amyl ester of sulfonated oleic acid (or the sulfate), together with a coco diethanolamine condensation amide modified with tallow fatty acid. The formulation is placed in aqueous solution, with the solution being capable of periodic or continuous partial removal for filtration to separate the aqueous solution from entrained abrasive particles.

3 Claims, No Drawings

FINISHING COMPOUND FOR BARREL AND VIBRATORY SURFACE CONDITIONING OF FERROUS AND NON-FERROUS METALS

BACKGROUND OF THE INVENTION

The present invention relates generally to a finishing compound for barrel and/or vibratory surface conditioning of metallic components, and more particularly to such a finishing compound which is capable of use with formation of only modest frothing or foaming, and further which is capable of either continuous or periodic filtration in order to separate entrained abrasive particles from the aqueous solution.

The surface conditioning of metallic components, including both ferrous and non-ferrous metallic components is a widely utilized process in industry. Mass production requires means for conditioning surfaces for either enhancing the appearance, or preparing the surface for subsequent chemical treatment, such as electroplating or painting, as well as meeting other miscellaneous functional requirements. In order to render such an operation economically feasible, means must be provided to economically condition the surfaces of the metallic components without sacrificing quality.

Because of the economic demands of material treatment, metal surface conditioning must be undertaken with a view toward minimizing expenditure of time and materials. Also, the environment must be protected from exposure to materials which may contaminate or otherwise deleteriously affect surface or subterranean water. The method and formulation of the present invention is one which permits surface conditioning to be undertaken without adversely affecting either the product quality or the environment.

Barrel and/or vibratory surface treatments have become widely recognized as a processing operation of industry. These techniques are widely accepted and have replaced in whole or in part such other labor intensive operations as belt sanding, wire brushing, hand scraping, electric or air-powered hand grinding, abrasive blasting, hand filing, buffing and the like. Those finishing operations which may be performed by either barrel or vibratory processing include cleaning, de-scaling, grinding and polishing, with this form of finishing being undertaken and completed without adversely affecting the quality of the parts being treated.

Normally, the parts to be treated are loaded into a receptacle for the barrel or vibratory element along with a finishing media and an aqueous compound. A wide variety of abrasive media are available commercially for this purpose, and the formulations of the present invention are adaptable for use with those various abrasive media which are presently utilized.

SUMMARY OF THE INVENTION

In connection with the present invention, the term "tumbling" is intended to include both barrel and vibratory surface conditioning treatments. Both operations subject the metallic components to relative motion within a finishing media, and the formulation of the present invention is adaptable for any of these operations. Basically, the barrel surface conditioning devices operate on the principle of low pressure abrasion being applied to the components by controlled sliding and/or rolling of the media. The components are immersed in an abrasive compound, along with the aqueous surface treating component. The barrel containing the components, media, and aqueous surface treating component is rotated so as to impart the sliding and rolling action to the individual components. Typically, the barrel is either a hexagonal or octagonal open top cylinder, fabricated from steel or other material of construction. The capacity for receiving loads may vary from one quart to 40 cubic feet or even larger. In certain installations, linings are provided to protect the work from tumbling against the inner wall surfaces, with these linings typically being rubber, neoprene, polyurethane, polyvinyl chloride. Typically, barrels are driven at rotational velocities of from 8 to 30 rpm, depending upon size and application requirements. Approximately 90% of the work is accomplished within the container by the sliding action which occurs when the abrasive media slides or rolls along the parts.

In vibratory finishing operations, the work on the surface of the parts is accomplished by the peening and scrubbing action which occurs between the media and the parts as the container is vibrated. The vibratory or rolling action of the tub maintains the load contained therein in constant motion, with cycle times typically being shorter for vibratory than for barrel finishing. By way of selection of operations, the vibratory finishing machines are typically utilized where the components contain holes, slots, or other obscure areas which may not be treated through conventional barrel finishing. The vibratory finishing machines perform the functions of de-scaling, cleaning and polishing, with delicate parts having critical sizes being processed within this equipment.

As previously indicated, the inner surface of the product receiving container may be lined, with these linings providing traction for the work-load movement and protection for the individual parts. In vibratory treatment systems, the frequency and amplitude of the energy is controllable, with the tub or enclosure typically moving in either a circular or elliptical path. Typical frequencies range from between about 900 to 2500 cycles per minute, with the driving frequencies being coupled to the frequency of the drive motor, such as 1200 rpm or 1800 rpm.

In selecting operating parameters, a higher amplitude will tend to generate more peening between the individual components, with a lower amplitude yielding primarily a scrubbing type operation. The selected variations of amplitude and/or frequency will determine the operation on the individual metallic components, with increased media pressure being obtained with a higher frequency motion.

MEDIA MASS FINISHING

The utilization of a media in finishing operations enhances the ability of the operation to treat small to medium-sized parts, with the treatment being more uniform and complete. The media available includes natural-occurring media such as limestone, quartz, granite, or other abrasive material. In another form, the abrasive material is molded in a pre-form, with the abrasive normally being fused or bonded aluminum oxide. This type of pre-form provides a relatively dense product with hard abrasives, thereby achieving a rapid cutting rate. Other media material which is typically utilized include walnut shells, ground corn cobs, carpet tacks, steel pins, and small metallic spheres, each providing its own special final surface finish.

The utilization of pre-formed shaped media reduces resident time, fracturing, and provides improved cutting rates and finish qualities. The pre-forms permit utilization with a wider variety of part sizes and weight and density ranges, with the geometry of the parts being selected from cylinders, cones, triangles, spheres, three-point stars, and others. The density of the pre-forms typically range from between about 85 to 110 pounds per cubic foot. The abrasives normally used are selected from the group consisting of aluminum oxide, silicon carbide, as well as mixtures thereof.

The utilization of a plastic bonded media expands the range of parts which may be processed even further. Again, plastic bonded media is available in a variety of shapes and sizes, with the configurations being generally dissimilar to those described above. The densities are in the range of approximately 50 pounds per cubic foot, and include such abrasives as aluminum oxide, silicon carbide, quartz and silica.

Regardless of the specific media employed, the function of media attrition is important. During the treating cycle, the media is subjected to attrition, and certain of the media is removed from the pre-form. The specific rate of wear is determined by inter-media friction, and generally not the friction existing between the individual metallic part and the media. Rates of attrition are determined by the size, composition and hardness of the media, as well as the type of operation being employed. Utilization of an aqueous treatment compound has been found to accelerate the treatment of the parts, while minimizing the rate of attrition of the pre-forms in the media. In this connection, the addition of an aqueous solution of a treatment compound will extend the life of the media by reducing the pressure exerted by the media upon itself, and generally reducing media pressures to the components being treated. In the past, a soapy aqueous solution or compound was utilized, however it has been found that soapy compounds are undesirable because of the formation of stable foams.

Media-compound interaction is desirable. Specifically, when dealing with a plastic resin pre-form, small particles of the abrasive are released during the processing, thus providing a fresh surface and natural media attrition. While the attrition is desirable from the standpoint of metal finishing, problems are developed which require resolution, including maintaining the formation of foam or suds at a desirable level, and also permitting cleansing of the surface. Generally, uncontrollable foaming or sudsing is not desirable, since it dampens media action and limits filtration. Also, the release of abrasives and polyester resin solids tends to stabilize the suds or foam generated, thus presenting additional problems. Since filtration and re-processing of the fluids for utilization is desirable from the standpoint of cost, pollution, and the like, problems with frothing and foaming tend to limit the capability of filtration. The formulation of the present invention renders such filtration operations possible and they are facilitated generally with ease. The formulation of the present invention contains a strong dispersing agent for eliminating or controlling the frothing and sudsing. Filtration may be used to remove soil and free abrasive accumulations, thereby re-cleaning the compound for re-introduction into the treatment chamber. The compound life is extended many times over that of a single system.

The active ingredients of the formulation include the tetrasodium salt of ethylenediaminetetraacetic acid, triethanolamine, the sodium salt of the amyl ester of sulfonated oleic acid (or the sulfate) as well as a coco-diethanolamine condensation amide modified with tallow fatty acid. This material is prepared to form a water-base stable concentrate, with the stable concentrate containing about 60% by weight of water. It will be understood that other concentration ranges may be useful, including a range of from 40 to 80%. The concentrate is diluted in the working solution to the extent that the working solution contains from about 0.5 to 2% of concentrate.

Therefore, it is a primary object of the present invention to provide an improved aqueous solution for use in the treatment of metallic surfaces, with the solution being particularly adapted for use with pre-formed media, and with the solution being capable of filtration and re-use.

It is a further object of the present invention to provide an improved concentrate for use in aqueous solutions of tumbling operations for metallic components, and wherein the aqueous solution is capable of providing a desired and controllable level of foaming, and is, nevertheless, susceptible of filtration and re-constitution.

It is yet a further object of the present invention to provide an improved aqueous-based formulation for metal tumbling operations, wherein the formulation is particularly adapted for use with pre-forms of abrasives and polyester resins.

Other and further objects of the present invention will become apparent to those skilled in the art upon a study of the following specification and appended claims.

DESCRIPTION OF THE PREFERRED EMBODIMENT

In order to provide a basis for comprehending the features of the present invention, the following specific example is provided:

EXAMPLE 1

| Ingredient | Percent by Weight |
|---|---|
| Tetrasodium salt of ethylene-diaminetetraacetic acid | 0.5 |
| Triethanolamine | 8.0 |
| Sodium salt of the amyl ester of sulfonated oleic acid | 20.0 |
| Coco diethanolamine condensation amide modified with tallow fatty acid | 10.0 |
| Water | 61.5 |

The formulation of Example I is prepared to form an aqueous base stable concentrate. In the working solution, 1% of the concentrate is normally required for introduction of the material into a barrel or vibratory processing unit, although a range of from about 0.5% to 2% is satisfactory. The solution, during use, will provide the necessary physical properties to sustain maximum operation of the tumbling unit (either barrel or vibratory) without adversely affecting the product. Foaming or sudsing due to soil saponification and stabilization by particles of abrasives and/or polyester resins is minimized, and in fact, rendered controllable. The working solution may be circulated through filtration and separation devices for reconstitution and ultimate re-introduction into the treatment chamber.

TABLE I

The individual components in the concentrate may be contained within the formulation to the following extent:

| Ingredients | Percent Range by Weight |
|---|---|
| Tetrasodium salt of ethylene-diaminetetraacetic acid | 0.2–2 |
| Triethanolamine | 5–15 |
| Sodium salt of the amyl ester of sulfonated oleic acid | 5–30 |
| Coco diethanolamine condensation amide modified with tallow fatty acid | 5–20 |
| Water | 40–80 |

Such a range of components has been found to be effective in the formulation of workable solutions.

DISCUSSION OF INDIVIDUAL COMPONENTS

Tetrasodium Salt of Ethylenediaminetetraacetic Acid

As can be appreciated, the tetrasodium salt of ethylenediaminetetraacetic acid is used primarily for water softening by chelation of magnesium and calcium cations which is responsible for water hardness. This component enhances the overall operation of the solution.

Triethanolamine

This component provides a source of alkalinity and pH control, functioning essentially as a buffer agent in this connection. This component also inhibits the formation of rust or scale of ferrous components.

Sodium Salt of the Amyl Ester of Sulfonated Oleic Acid

This component provides the source of particle dispersing, along with the yielding of a controllable low frothing or foaming solution. In the synthesis of this material, the oleic acid is preferably sulfonated by way of reaction with sulfur trioxide, and is thereafter esterified with amyl alcohol and finally neutralized with sodium hydroxide to form the sodium salt of the amyl ester of sulfonated oleic acid. As an alternate, and suitable as a 1:1 substitute, oleum may be used as the sulfating agent for the amyl oleate, with the procedures otherwise being identical. This reaction produces the sodium salt of the amyl ester of sulfated oleic acid.

The base amyl oleate may either be purchased or synthesized by reaction of oleic acid with amyl alcohol under presence of an acidic catalytic agent, normally sulfuric acid.

Coco Diethanolamine Condensation Amide Modified with Tallow Fatty Acid

Coconut oil alkanol amide is commercially available. This material is obtained as the reaction product of refined coconut oil, animal fatty acid, diethanolamine, and sodium methoxide. The compound provides lubricity to the parts, with certain soil removing capability, along with rust inhibiting characteristics. This component also maintains the aqueous solution of the concentrate to impart a wettability of the metallic parts by the media, thereby providing a free-flowing of the work load within the tumbling unit.

Synthesis of Coco Diethanolamine Condensation Amide Modified with Tallow Fatty Acid In order to prepare this component, which is reasonably commercially available, the following components are utilized:

| Component | Percent by Weight |
|---|---|
| Refined coco oil | 39.3 |
| Diethanolamine | 37.6 |
| Sodium methoxide | 0.9 |
| Animal fatty acid | 22.2 |

The refined coconut oil and diethanolamine are mixed together and heated to a temperature of between 220°–250° F. and maintained at that level for a period of 5 to 6 hours. The material is permitted to cool to a temperature of approximately 160°–170° F., at which time the sodium methoxide is added. Thereafter, the distilled animal fatty acid is added and the mixture is permitted to cool to room temperature.

The diethanolamine preferably contains 98.5% diethanolamine, with approximately 1% of either or both triethanolamine and monoethanolamine. The sodium methoxide is available as a 25% mixture in methanol, with such materials being commercially available widely. The distilled animal fatty acid is a mixture of a variety of animal acids, including the following:

| | |
|---|---|
| Palmitic acid | 27% |
| Stearic acid | 18% |
| Palmitoleic acid | 39% |

Such materials are, of course, commercially available.

The resulting synthesized product contains from 20 to 22% of free diethanolamine, which is desirable in the finished product.

What is claimed is:

1. In the method of imparting a smooth finish to metallic components while subjecting said metallic components to a tumbling action within a finishing media, said method comprising:

(a) immersing a plurality of metallic parts in a treating enclosure containing a finishing media and wherein the media comprises abrasive particles and an aqueous working solution of a metal finishing compound, and wherein said metal finishing compound has a formulation:

| Component | Percent by Weight |
|---|---|
| Tetrasodium salt of ethylene-diaminetetraacetic acid | 0.2–2 |
| Triethanolamine | 5–15 |
| Sodium salt of the amyl ester of a sulfur containing salt of oleic acid selected from the group consisting of the amyl ester of sulfonated oleic acid and the amyl ester of sulfated oleic acid | 5–30 |
| Coco diethanolamine condensation amide modified with tallow fatty acid | 5–20 |
| Water | 40–80 |

(b) subjecting said metallic components to a tumbling action; and (c) removing a portion of said aqueous working solution from said enclosure and separating said aqueous working solution from entrained abrasive particles.

2. The method as defined in claim 1 being particularly characterized in that said removal of a portion of said aqueous working solution occurs continuously during the subjection of the metallic components to tumbling action.

3. The method as defined in claim 1 wherein said formulation is as follows:

| Component | Percent by Weight |
|---|---|
| Tetrasodium salt of ethylene-diaminetetraacetic acid | 0.5 |
| Triethanolamine | 8.0 |
| Sodium salt of the amyl ester of sulfonated oleic acid | 20.0 |
| Coco diethanolamine condensation amide modified with tallow fatty acid | 10.0 |
| Water | 61.5 |

* * * * *